US010934836B2

(12) United States Patent
Lanning et al.

(10) Patent No.: US 10,934,836 B2
(45) Date of Patent: Mar. 2, 2021

(54) VERIFIABLE DOWNLINKING METHOD

(71) Applicant: DOUBLEBARREL DOWNHOLE TECHNOLOGIES LLC, Houston, TX (US)

(72) Inventors: Curtis Lanning, Montgomery, TX (US); Sassan Dehlavi, Houston, TX (US); Jeff Kurthy, Houston, TX (US)

(73) Assignee: Doublebarrel Downhole Technologies LLC, Houston, TX (US)

( * ) Notice: Subject to any disclaimer, the term of this patent is extended or adjusted under 35 U.S.C. 154(b) by 233 days.

(21) Appl. No.: 16/148,636

(22) Filed: Oct. 1, 2018

(65) Prior Publication Data

US 2020/0102816 A1 Apr. 2, 2020

(51) Int. Cl.
*E21B 47/12* (2012.01)
*E21B 7/04* (2006.01)

(52) U.S. Cl.
CPC ..... *E21B 47/12* (2013.01); *E21B 7/04* (2013.01)

(58) Field of Classification Search
CPC ..... E21B 47/12; E21B 7/04
See application file for complete search history.

(56) References Cited

U.S. PATENT DOCUMENTS

| | | | | |
|---|---|---|---|---|
| 4,734,892 | A | 3/1988 | Kotlyar | |
| 4,763,258 | A * | 8/1988 | Engelder | E21B 47/12 340/853.3 |
| 5,197,040 | A | 3/1993 | Kotlyar | |
| 5,586,084 | A | 12/1996 | Barron et al. | |
| 6,206,108 | B1 | 3/2001 | MacDonald et al. | |
| 6,427,783 | B2 | 8/2002 | Krueger et al. | |
| 6,714,138 | B1 | 3/2004 | Turner et al. | |
| 6,970,398 | B2 | 11/2005 | Lavrut et al. | |
| 7,298,285 | B2 | 11/2007 | Moriarty | |
| 9,428,961 | B2 | 8/2016 | Benson et al. | |
| 9,500,075 | B2 | 11/2016 | Logan et al. | |
| 9,506,335 | B1 | 11/2016 | Smith | |
| 9,822,633 | B2 | 11/2017 | Sugiura | |
| 2003/0220742 | A1 | 11/2003 | Niedermayr et al. | |
| 2008/0156531 | A1 | 7/2008 | Boone et al. | |
| 2016/0145992 | A1 | 5/2016 | Parkin et al. | |
| 2017/0254190 | A1 * | 9/2017 | Jones | E21B 44/005 |
| 2018/0066513 | A1 * | 3/2018 | Sugiura | E21B 47/26 |

FOREIGN PATENT DOCUMENTS

| | | |
|---|---|---|
| CN | 103573258 | 6/2016 |
| WO | 2016108822 | 7/2016 |
| WO | 2017069753 | 4/2017 |
| WO | 2017121976 | 7/2017 |
| WO | 2017151394 | 9/2017 |

OTHER PUBLICATIONS

PCT International Search Report issued in corresponding PCT Application No. PCT/US2019/053243 dated Dec. 17, 2019, pp. 1-9.

* cited by examiner

*Primary Examiner* — Giovanna Wright
*Assistant Examiner* — Jonathan Malikasim
(74) *Attorney, Agent, or Firm* — McAfee & Taft

(57) ABSTRACT

Disclosed are methods for transmitting data to a downhole tool. The methods include the option of confirming receipt and implementation of the transmitted data by the downhole tool. The disclosed methods utilize changes in RPM of the tool to convey the data through three separate changes in RPM. The changes in RPM are used to generate pulses suitable for identifying preprogrammed actions found within the memory of the downhole tool.

39 Claims, 6 Drawing Sheets

| | Target Duration | | | Actual Duration | | | | | |
|---|---|---|---|---|---|---|---|---|---|
| | X-pulse | T-pulse | Y-pulse | X-pulse | T-pulse | Y-pulse | Xeval | COR | Yeval |
| Example 1 | 40 | 20 | 40 | 46.1 | 12.8 | 46.6 | 38.9 | 7.2 | 39.4 |
| Example 2 | 20 | 20 | 20 | 22.9 | 17.2 | 22.6 | 20.1 | 2.8 | 19.8 |
| Example 3 | 20 | 20 | 20 | 32.2 | 8.2 | 26.2 | 20.4 | 11.8 | 14.4 |
| Example 4 | 20 | 20 | 100 | 27 | 13.1 | 107.4 | 20.1 | 6.9 | 100.5 |

| | Determination of Successful Downlink using Tolerances | | | | | |
|---|---|---|---|---|---|---|
| | Variation | | | Variation | | |
| | X-pulse | T-pulse | Y-pulse | Xeval | Yeval | Pass / Fail |
| Example 1 | 6.1 | -7.2 | 6.6 | -1.1 | -0.6 | Pass |
| Example 2 | 2.9 | -2.8 | 2.6 | 0.1 | -0.2 | Pass |
| Example 3 | 12.2 | -11.8 | 6.2 | | | Fail |
| Example 4 | 7 | -6.9 | 7.4 | 0.1 | 0.5 | Pass |

| Passing Criteria | |
|---|---|
| T-pulse | ±10sec |
| Xeval | ±5sec |
| Yeval | ±5sec |

FIG. 2

VERIFIABLE DOWNLINKING METHOD

BACKGROUND

Directional drilling operations frequently use a rotary steerable system (RSS) to push the drill bit in the desired direction. Accurate control of the RSS is essential to controlling the cost of such drilling operations. An error of one degree can result in the displacement of the well bore by several hundred feet. Challenges commonly encountered during such drilling operations include: torsional oscillation of the drill string which produces erroneous drill bit RPM measurements; signal delays from the surface to the RSS; and, inability of the RSS to detect the control signal originating from the surface. Signal transmission from the surface to the RSS and from the RSS to the surface is typically achieved by either mud pulse through the drill string or electromagnetic signal through the subterranean environment. The following disclosure describes a method for verifying the receipt and implementation of the steering change by the RSS.

SUMMARY

Disclosed herein are methods for verifying the receipt and implementation of a signal by a controllable downhole tool. The method begins with positioning a controllable downhole tool and at least one sensor configured to monitor the RPM of the controllable downhole tool in a borehole. The controllable downhole tool includes a programmable memory containing at least one lookup table preprogrammed with commands for controlling the controllable downhole tool. To implement a command within the controllable downhole tool a signal is sent to the tool instructing it to implement a command from the lookup table. The signal is transmitted to the controllable downhole tool by manipulating the RPM of the controllable downhole tool. The transmission of the signal includes the steps of:

establishing a Starting RPM for the controllable downhole tool;

reducing the RPM of the controllable downhole tool from the Starting RPM;

establishing a Threshold RPM where the Threshold RPM is at least 5 RPM below the Starting RPM;

establishing a target X-pulse duration;

initiating the X-pulse;

begin recording the X-pulse when the RPM drops below the Threshold RPM and continuing to record the X-pulse until the RPM increases to the Threshold RPM where the actual X-pulse duration equals the number of seconds from RPM dropping below the Threshold RPM and the RPM returning to the Threshold RPM;

establishing a target T-pulse duration;

initiating the T-pulse when the RPM returns to the Threshold RPM;

recording the T-pulse;

concluding the T-pulse by reducing the RPM of the controllable downhole tool to the Threshold RPM where the actual T-pulse duration equals the number of seconds from RPM rising above the Threshold RPM and the RPM returning to the Threshold RPM;

establishing a target Y-pulse duration;

initiating a Y-pulse;

begin recording the Y-pulse when the RPM drops below the Threshold RPM and continuing to record the Y-pulse until the RPM increases to the Threshold RPM where the actual Y-pulse duration equals the number of seconds from RPM dropping below the Threshold RPM and the RPM returning to the Threshold RPM;

using the actual T-pulse duration to establish a correction factor using the following formula: COR=target T-pulse−(actual T-pulse duration);

determining an Xeval value by the formula Xeval=actual X-pulse duration−(COR);

determining a Yeval value by the formula Xeval=actual X-pulse duration−(COR);

determining the acceptability of the signal to the controllable downhole tool to implement a command from the lookup table, the signal is acceptable when the actual T-pulse duration value is within ±30 seconds of the target T-pulse duration, the Xeval is ±15 seconds of the target X-pulse duration and the Yeval±15 seconds of the target Y-pulse duration and upon determination of an acceptable signal, then the downhole tool uses the Xeval and the Yeval to select a preprogrammed command from the lookup table.

In an alternative embodiment, the requirement to drop the RPM of the controllable downhole tool from the Starting RPM to value below the Threshold RPM to generate the X-pulse and Y-pulse is altered to provide for increasing the RPM of the controllable downhole tool from the Starting RPM to a value above the Threshold RPM. In this embodiment, the T-pulse is initiated when the RPM returns to the Threshold RPM and concludes when the RPM rises above the Threshold RPM.

In another alternative embodiment, the manipulation of the RPM may utilize either an increase or decrease for each of the T-pulse, the X-pulse and the Y-pulse. The actual T-pulse duration, actual X-pulse duration and actual Y-pulse duration are each determined relative to a Threshold RPM.

BRIEF DESCRIPTION OF THE DRAWINGS

FIG. 2 provides data reflective of the disclosed method.

DETAILED DESCRIPTION

Figure 1:
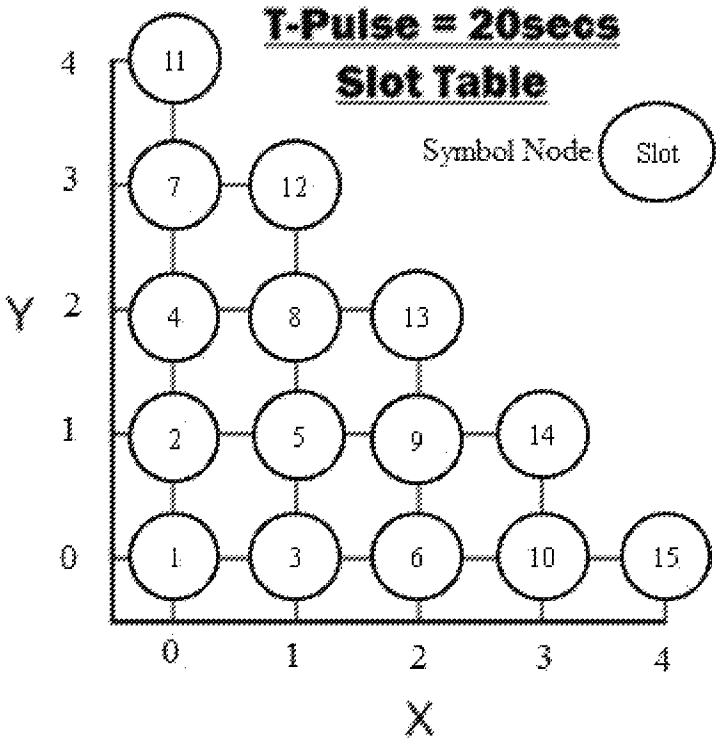
FIG. 1 depicts a slot table, also known as a lookup table.

The methods disclosed herein provide the ability to convey data to any controllable rotatable downhole tool such as, but not limited to, motors, reamers, circulating tools, drill bits and rotary steerable systems. In general, if the downhole tool has associated electronics responsive to signals received from the surface, then the disclosed methods provide the ability to accurately convey data and verify the receipt and implementation of the data by the downhole tool. For simplicity purposes, the following discussion describes the implementation of the method in a rotary steerable system (RSS).

Data may be conveyed to an RSS located in the downhole environment through RPM changes initiated by a top drive, a Kelly drive located at the drill rig or a mud motor within a bottom hole assembly or other mechanisms for changing the RPM of a rotatable downhole tool. The disclosed method provides improvements over the conventional RPM based methods by overcoming problems presented by delays in RPM changes. Further, the disclosed method recognizes that every region of the borehole has unique properties; therefore, every region has a unique signature relative to tool RPM. More importantly, the disclosed method provides the ability to transmit a command to the RSS and automatically receive confirmation of receipt and implementation of the command or an automatic indication of the failure of the transmission.

To overcome the problems presented by the time delay associated with transmission of the signal, the method utilizes the steps described below. The disclosed method scales three different time factors: X-pulse, T-pulse and Y-pulse. The T-pulse factor is unique to the location of the rotatable tool and the configuration of the drill rig. The T-pulse provides a correction factor which accommodates changes in the downhole environment. The X-pulse and Y-Pulse provides the information necessary for using a lookup or slot table commonly included as part of the internal programming of an RSS and other rotatable tools. The unique use of the time factors allows for rapid determination of a successful downlink or unsuccessful downlink.

Downhole communication methods, such as use of a mud bypass valve and RPM shifting, are well known to those skilled and the art. As such, these communication techniques will not be discussed in detail. In general terms, the mode of communicating a signal to the downhole environment will of course depend on the configuration of the drill rig and the configuration of the tools used during drilling operations. If the tools include a pressure transducer suitable for interpreting mud pressure, then mud pressure may be used to control a mud motor and in turn the RPM of the drill bit, RSS or other rotatable tool. Alternatively, downhole tools may include an RPM sensor or other similar device which can communicate RPM changes to the RSS. Under these conditions, when the drill rig relies upon a Kelly drive or a top drive to provide rotary movement to the drill bit, then the downhole tools will include an RPM sensor or other sensor suitable for monitoring changes in drill bit and/or RSS and such sensor will be capable of communicating changes in RPM to the RSS. If the downhole tools are included as part of a bottom hole assembly (BHA), then a mud motor may be included in the BHA. In this configuration, flow changes at the surface could be used to vary RPM at the RSS or drill bit. In all common drilling configurations, sensors such as, accelerometers, gyroscopes and magnetic sensors are commonly used to monitor RPM of either the RSS or drill bit.

FIG. 1 provides an example look up table in the form of a matrix along the X and Y axes. While the number of positions in a lookup table may vary, the example of FIG. 1 provides the RSS with up to 15 preprogrammed functions. One example, of a preprogrammed function would include directing the RSS to change the target inclination to ten degrees. Those skilled in the art will be familiar with the type of commands commonly preprogrammed into an RSS. When used in connection with another tool, the command may be to turn off the tool or turn on the tool.

As will be discussed in more detail below, the transmission of a signal from the surface to the RSS will determine the applicable slot used by the RSS. For example, the service operator may manipulate the transmission to produce an X-pulse and a Y-pulse which using the method described below results in the desired Xeval and Yeval values. In the example of FIG. 1, an Xeval within ±5 seconds of 20 seconds corresponds to an X value of 0 on the lookup table. Likewise, a Yeval within ±5 seconds of 40 seconds corresponds to a Y value of 1 on the lookup table. Thus, an X value of 0 and a Y value of 1 correspond to slot 2 in the lookup table of FIG. 1. The lookup table may be expanded as necessary and as permitted by the memory storage capacity of the RSS.

Accurate selection of the desired slot in the lookup table requires transmission of a signal that can be received and interpreted by the RSS. While the component for each position on the X and Y axes may be assigned any Xeval or Yeval value, in a typical look up table, the time value for each position increases as one moves along the X and Y axes. For example, in the look up table of FIG. 1, position zero on both the X- and Y-axes is 20 seconds and position 1 corresponds to 40 seconds. The time period assigned to each position will generally consider the configuration of the drilling rig, the tools incorporated into the drill string and the subterranean environment. In particularly noisy environments, longer X-pulse and Y-pulses may be required to ensure transmission of an acceptable signal. However, when appropriate, shorter pulses may be assigned to each position, as shorter pulses reduce the period of inoperability for the drill rig.

The following method provides the ability to verify that the signal to the RSS has been received and properly interpreted by the RSS. Additionally, the disclosed method may be practiced with the drill bit off-the-bottom of the wellbore or on-the-bottom of the wellbore and in drilling operations.

The following discussion describes the use of the method with the drill bit in an off-the-bottom location. Typically, with the drill bit off-the-bottom, the drill bit will be at zero RPM. When the operator of the drill rig determines the desirability of transmitting a signal to the RSS, e.g. a desire to change drilling direction, the operator will initiate conditions to establish a steady state RPM (Starting RPM) of the drill bit, i.e. the drill bit will ramp up to the desired RPM. Alternatively, the operator may utilize a Starting RPM that references the RPM of the RSS. Thus, in the disclosed methods, the Starting RPM and other RPM measurements may reference any of the drill bit, the RSS or other rotatable tool as all such reference points will satisfy the operational conditions described herein. For the purposes of the remainder of the disclosure, the method will refer to RSS RPM for all RPM data. The techniques necessary for changing RSS RPM are well known to those skilled in the art. Typically, when operating a drill rig that drives the drill bit from the surface using a Kelly or top drive, the drive unit will be manipulated to provide the requisite change in RPM for the RSS. When operating with a downhole mud motor, a bypass valve or directly changing the mud flow rate via pumps at the rig may be used to signal the change in RPM.

Upon receipt of a signal from the surface, the RSS RPM will stabilize at a Starting RPM for at least about 25 to about 80 seconds, preferably about 35 seconds. Upon establishment of the Starting RPM, the system is ready to initiate determination of the actual X-pulse, actual Y-pulse and actual T-pulse values. The precise value of the Starting RPM is not critical to the method as all measurements are taken relative to the Starting RPM with reference to a Threshold RPM.

Upon establishment of the Starting RPM for the indicated period of time, the RPM of the drill bit is allowed to drop. The X-pulse measurement begins when drill bit RPM drops from about 5 RPM to about 300 RPM below the Starting RPM. In general, an RPM drop of about 10 RPM to about 15 RPM will provide suitable data. Typically, the target will be a drop of 15 RPM. The value between 5 and 300 selected is known as the Threshold RPM.

Provided that the RPM drops below the Threshold RPM, initiation of the X-pulse measurement is achieved. Once the X-pulse measurement begins, a subsequent increase in RPM within the first 3 to 4 seconds after dropping below the Threshold RPM, preferably not more than 3.5 seconds, will be ignored and the X-pulse measurement will continue. However, if the RPM remains above the Threshold RPM for more than 4 seconds, then the X-pulse will close and the T-pulse will begin. As a result, the evaluation of the signal will result in rejection of the downlink and in the case of an RSS, the RSS will typically transmit a signal indicating that the prior command remains the active command. (NOTE: when practiced in other rotatable tools a confirmation signal may not be required, e.g. when a reamer is controlled by this method a change in monitored drilling mud pressure will indicate the success or failure of the signal.) The X-pulse measurement continues for the time period appropriate to generate an Xeval value for the slot table position necessary for selecting the new command. The target X-pulse duration may range from about 8 to about 120 seconds. However, under conventional operating conditions the target X-pulse duration will be about 20 seconds. During the generation of the X-pulse measurement, RPM data is collected as a rolling average every 0.1 second.

Upon completion of the X-pulse measurement, drill bit RPM returns to the Starting RPM. The T-pulse measurement begins during the increase of the drill bit RPM to the Starting RPM. Specifically, the T-pulse measurement begins when drill bit RPM returns to the Threshold RPM and continues for a period of about 8 seconds to about 120 seconds. The RPM may increase above the Starting RPM during the T-pulse or may remain at the Threshold RPM or between the Threshold RPM and the Starting RPM. Upon initiation of the T-pulse measurement begins, a subsequent decrease in RPM below the Threshold RPM within the first 3 to 4 seconds after rising above the Threshold RPM, preferably not more than 3.5 seconds, will be ignored and the T-pulse measurement will continue. To reduce periods of drill rig inoperability, the target T-pulse duration may range from about 20 seconds to 50 seconds at or above the Threshold RPM. During the generation of the T-pulse measurement, RPM data is collected as a rolling average every 0.1 second. The T-pulse measurement accounts for the unique characteristics of the subterranean environment at the present location of the RSS or Drill Bit. As discussed in detail below, the T-pulse measurement provides the correction factor (COR) used in the evaluation of the X-pulse and Y-pulse.

Additionally, the RSS can be preprogrammed with multiple lookup tables. If the RSS has two or more preprogrammed lookup tables, then the length of the T-pulse will be used to select the appropriate lookup table. For example, in an RSS preprogrammed with two lookup tables, a T-pulse of about ten seconds to 30 seconds may direct the RSS to select a first lookup table while a T-pulse of about 40 to 80 seconds may direct the T-pulse to select a second lookup table. Depending on RSS memory capacity, additional lookup tables can be added and selected in a similar manner.

Upon completion of the T-pulse measurement, the RPM once again drops in order to generate the Y-pulse measurement. The Y-pulse measurement begins when drill bit RPM drops below the Threshold RPM. Provided that the RPM drops below the Threshold RPM, initiation of the Y-pulse measurement is achieved. Once the Y-pulse measurement begins, a subsequent increase in RPM within the first 3 to 4 seconds after dropping below the Threshold RPM, preferably not more than 3.5 seconds, will be ignored and the Y-pulse measurement will continue. However, if the RPM remains above the Threshold RPM for more than 4 seconds, then the Y-pulse will close. As a result, the evaluation of the signal will result in rejection of the downlink and the RSS will transmit a signal indicating that the prior command remains the active command. The Y-pulse measurement continues for the time period appropriate to generate a Yeval value for the slot table position necessary for selecting the new command. The target Y-pulse duration may range from about 8 to about 120 seconds. Under conventional operating conditions the target Y-pulse duration will be about 20 seconds. During the generation of the Y-pulse measurement, RPM data collected as a rolling average every 0.1 second.

Figure 3A:
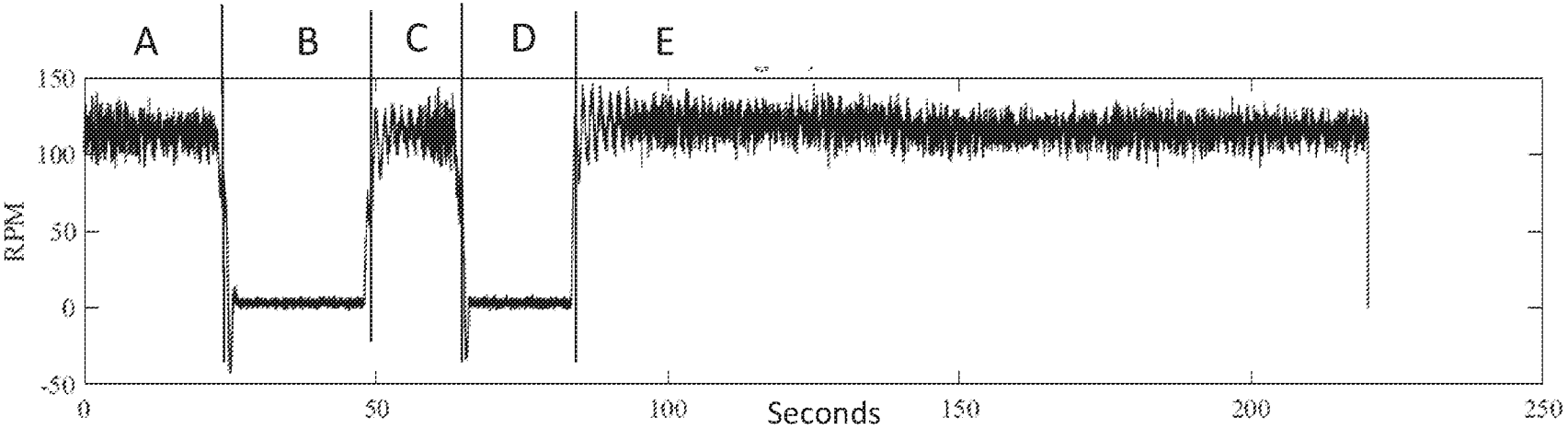
FIGS. 3A, 4A, 5A and 6A depict drill bit RPM over time.
Figure 3B:
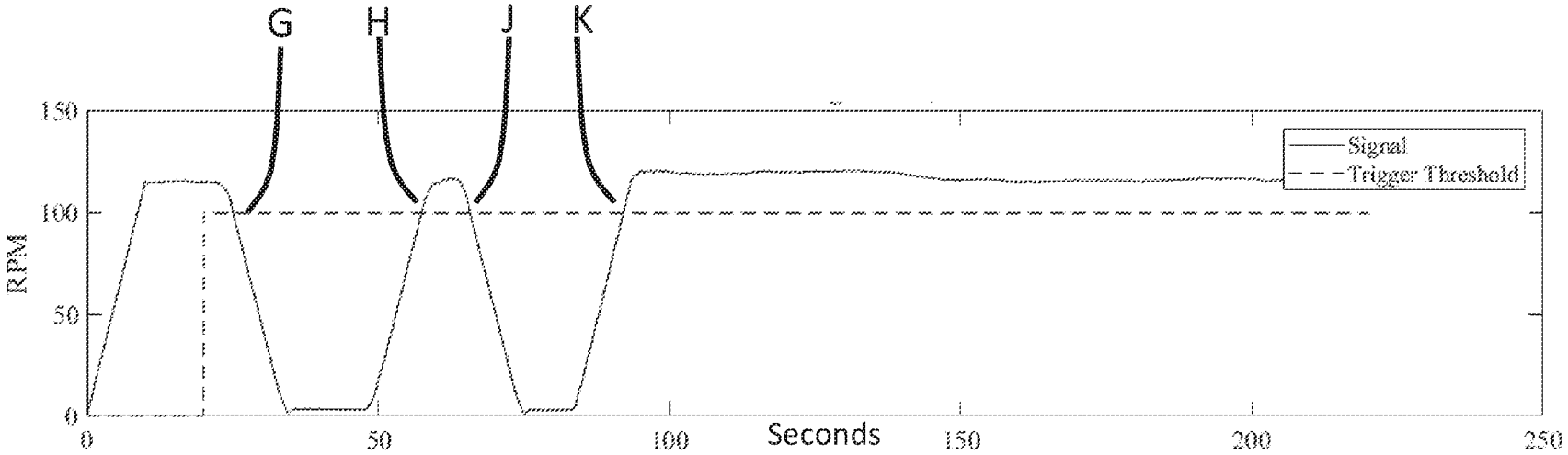
FIGS. 3B, 4B, 5B and 6B depict the data of FIGS. 3A, 4A, 5A and 6A after decimation and processing.

FIG. 3A depicts the RPM data for a downlink attempt. As reflected in FIG. 3A, the Starting RPM, region A, has been established for a period of about 35 seconds. Region B corresponds to the actual X-pulse duration. Region C corresponds to the actual T-pulse duration and Region D corresponds to the actual Y-pulse duration. Region E corresponds to the concluding RPM. All data points are gathered and stored in the RSS. Following collection of the data, the data is decimated by reducing the signal from 100 Hz to 10 Hz. The decimating step produces the smoother function of FIG. 3B. In FIG. 3B, the dashed line represents the Threshold RPM for initiating and completing the X, Y and T pulses. Thus, the X-pulse begins at location G, where the decimated data line crosses the threshold, and ends at location H, where the decimated data line again crosses the threshold. The T-pulse begins at location H and ends at location J. The Y-pulse begins at location J and ends at location K.

Using the data, provided by the filtering and decimation steps, one can generate values for Xeval and Yeval. The values of Xeval, Yeval and actual T-pulse duration will determine the successful transmission of a signal from the surface to the RSS.

Determination of the Xeval and Yeval begins with analysis of the actual T-pulse duration value. The tolerance or variation range for each pulse will vary with the environment. In noisy environments, longer X-pulse, Y-pulse and T-pulse ranges may be used and larger tolerance values applied. If the actual T-pulse duration value is within the ±tolerance value determined for the environment for the target T-pulse duration, then a correction value COR can be determined and applied to produce Xeval and Yeval. Thus, COR=target T-pulse duration−(actual T-pulse duration). Thus, depending on whether T-pulse duration is longer or shorter than the target for the T-pulse, COR may be a positive or negative value. Application of COR to the actual X-pulse duration provides the Xeval value, i.e. Xeval=actual X-pulse-duration−(COR). Likewise, application of COR to the actual Y-pulse duration provides the Yeval value, i.e. Yeval=actual Y-pulse-duration−(COR).

In a typical operating environment, a signal received at the RSS is deemed as being of acceptable quality for implementation of the Slot Table when: (a) actual T-pulse duration is within ±30 seconds of the target T-pulse duration, (b) Xeval value is ±15 seconds of target X-pulse duration, and (c) Yeval value is ±15 seconds of target Y-pulse duration. To reduce non-drilling time and when the drilling environment permits, a signal received at the RSS may be deemed as being of acceptable quality for implementation of the Slot Table when: (a) actual T-pulse duration is within ±20 seconds of the target time, (b) the Xeval value is within ±10 seconds of the target X-pulse duration, and (c) the Yeval value is within ±10 seconds of the target Y-pulse duration. For further efficiencies and again depending upon the environment an acceptable signal may utilize (a) actual T-pulse duration that is within ±10 seconds of the target time, (b) an Xeval value that is ±5 seconds of the target X-pulse duration, and (c) a Yeval value that is within ±5 seconds of the target Y-pulse duration. As discussed above, to minimize downtime of the drilling operation, the target X-pulse and target Y-pulse durations are preferably kept to a minimum time necessary for the operating conditions. If the shorter pulse periods result in frequent downlink failures, then the target pulse duration for the X, Y and T pulses may be increased. Additionally, upon increase of the target pulse ranges, the tolerance ranges for Xeval, T-pulse, and Yeval may be increased to ensure transmission of an acceptable downlink signal or decreased to take advantage of local environmental conditions.

Upon determination of the acceptability of the signal, the RSS replies to the surface that downhole conditions were appropriate for receipt of the new command and the reply repeats the desired RSS operational change to the surface. If the signal does not satisfy the criteria set forth above, the RSS will reply with a signal representative of the original RSS operating condition.

As noted above, the foregoing discussion related to an off-the-bottom positioning of the drill bit. When operating with the drill bit in an on-the-bottom location, the above method differs only with regard to the Starting RPM. Under these conditions, the RSS will receive a front signal, i.e. a trigger signal indicating that a downlink signal will be transmitted. The front signal defines the Starting RPM as the RPM of the rotatable tool at the time of receipt of the front signal. All other steps for transmitting and verifying the downlink signal are the same.

The foregoing discussion describes the method in terms of changing the Starting RPM to a value less than a Threshold RPM when determining the duration period for the X-pulse and the Y-pulse and the T-pulse duration is determined when RPM value returns to the Threshold RPM value. However, in an alternative embodiment, the method operates by changing the RPM to a value greater than the Threshold RPM when determining the duration period for the X-pulse and the Y-pulse and the T-pulse duration begins when the RPM value returns to and may continue to drop below the Threshold RPM value. During the T-pulse measurement, the RPM value may drop below the Starting RPM or may remain between the Starting RPM and the Threshold RPM. The criteria described above for determining an acceptable signal is then applied using the determined values and target values. However, when using an increase in RPM to establish the X-pulse and Y-pulse, then once the pulse measurement begins, a subsequent increase in RPM within the first 3 to 4 seconds after dropping below the Threshold RPM, preferably not more than 3.5 seconds, will be ignored and the pulse measurement will continue. Likewise, for the T-pulse once the T-pulse measurement begins, a subsequent increase in RPM within the first 3 to 4 seconds after dropping to the Threshold RPM, preferably not more than 3.5 seconds, will be ignored and the T-pulse measurement will continue.

In yet another embodiment, the method provides satisfactory results by establishing values for actual X-pulse duration, Y-pulse duration and T-pulse duration using either an increase or decrease in RPM relative to the Starting RPM. In this embodiment, separate Threshold RPM values are determined above and below the Starting RPM. As described above, target values for each of X-pulse, Y-pulse and T-pulse are established. Recording of the X-pulse begins when the RPM increases or decreases and crosses the relative Threshold RPM value. X-pulse recording ends when the RPM returns to the Threshold RPM value thereby establishing the actual X-pulse duration. Likewise, the T-pulse begins when the RPM increases or decreases and reaches or crosses the relative Threshold RPM value. T-pulse recording ends when the RPM returns to the threshold value thereby establishing the actual T-pulse duration necessary for determining the correction factor COR. Finally, the Y-pulse begins when the RPM increases or decreases and crosses the relative Threshold RPM value. Y-pulse recording ends when the RPM returns to the Threshold RPM value thereby establishing the actual Y-pulse duration. The criteria described above for determining an acceptable signal is then applied using the determined values and target values. However, when establishing the X-pulse and Y-pulse, once the pulse measurement begins, a subsequent increase or decrease in RPM within the first 3 to 4 seconds after rising or dropping below the Threshold RPM, preferably not more than 3.5 seconds, will be ignored and the pulse measurement will continue. Likewise, for the T-pulse once the T-pulse measurement begins, a subsequent decrease or increase in RPM within the first 3 to 4 seconds after rising or dropping below the Threshold RPM, preferably not more than 3.5 seconds, will be ignored and the T-pulse measurement will continue.

To enhance the understanding of the present invention, the non-limiting examples of FIGS. 3A through 6B will be discussed. The results depicted in FIGS. 2-6B reflect actual field testing of the disclosed invention.

FIGS. 3A and 3B correspond to Example 3 in FIG. 2. Example 3 and FIGS. 3A, 3B depict conditions where the downlink signal was unsuccessful. In this example, an acceptable signal required an actual T-pulse duration that was within ±10 seconds of the target T-pulse duration of 20 seconds. However, in this case the RPM data reflects an actual T-pulse duration of only 8.2 seconds. Thus, the T-pulse did not fall within ±10 seconds of the 20 second target time. As a result of the failure to maintain RPM for a sufficient period of time during the T-pulse, the method did not provide an acceptable Yeval value. Therefore, the signal transmission failed.

Figure 4A:
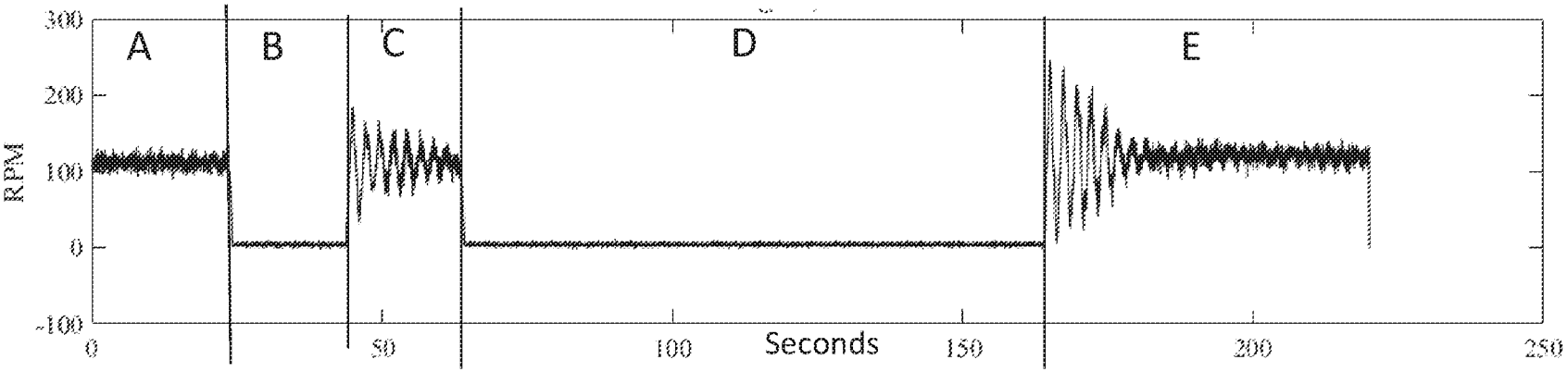
Figure 4B:
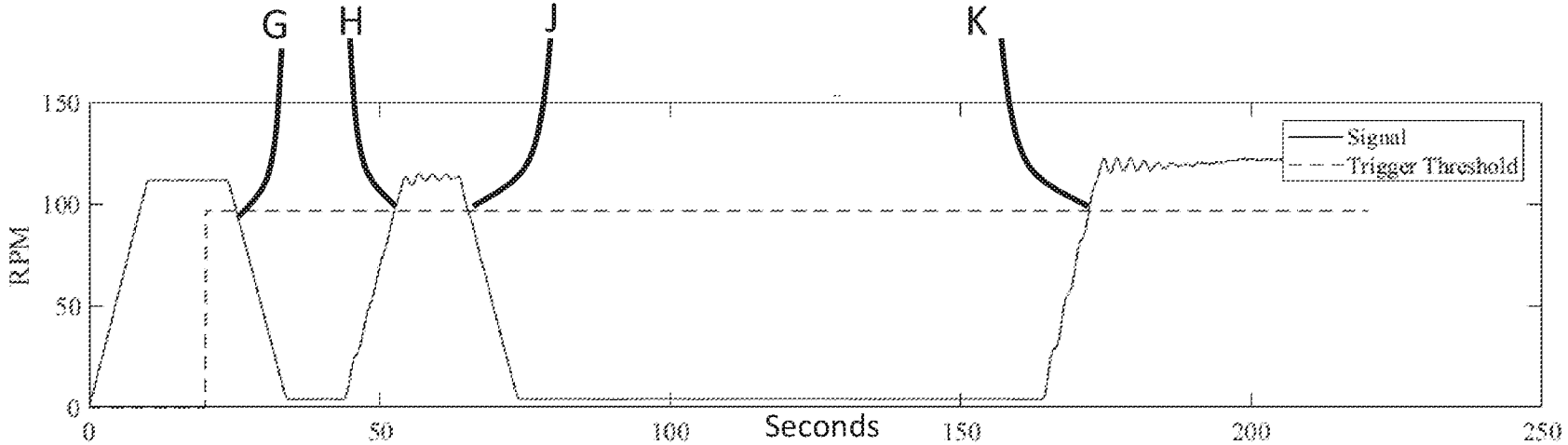

FIGS. 4A and 4B correspond to Example 4. Example 4 and FIGS. 4A, 4B depict conditions where the downlink was successful. This example demonstrates the use of the correction factor, COR, to provide an Xeval and Yeval within the required ±5 seconds of the target X-pulse duration and target Y-pulse duration necessary for ensuring a verifiable downlink. In this instance, the actual T-pulse duration registered as 13.1 seconds, i.e. within the ±10 of the 20 second target T-pulse duration. Additionally, the actual X-pulse duration and actual Y-pulse duration for the X-pulse and Y-pulse were 27 seconds and 107.4 seconds respectively. As indicated in FIG. 2, the target X-pulse duration value was 20 seconds and the target Y-pulse duration was 100 seconds. The correction factor, COR, for this example is 6.9 (COR=target T-pulse duration−actual T-pulse duration=20-13.1). Thus, by applying the correction factor to the actual period for the X-pulse and Y-pulse provides an Xeval value=actual X-pulse duration−(COR)=20.1 and a Yeval value=actual Y-pulse duration−(COR)=100.5. Thus, the correction factor provides Xeval and Yeval values within the ±5 seconds of the target values necessary for ensuring a verifiable downlink. The signal transmission was successful.

Figure 5A:
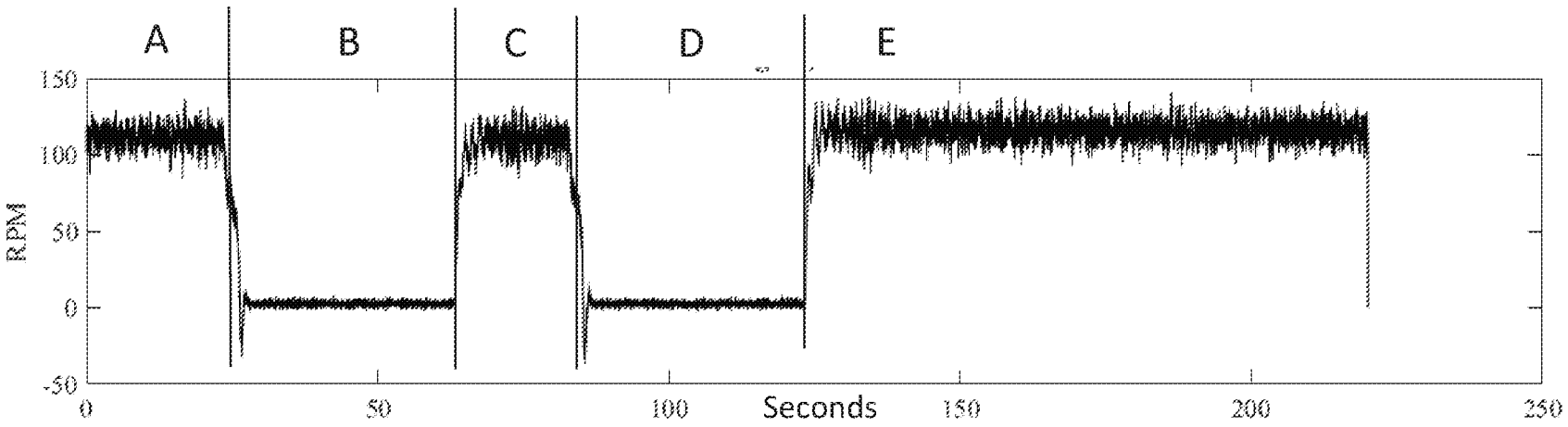
Figure 5B:
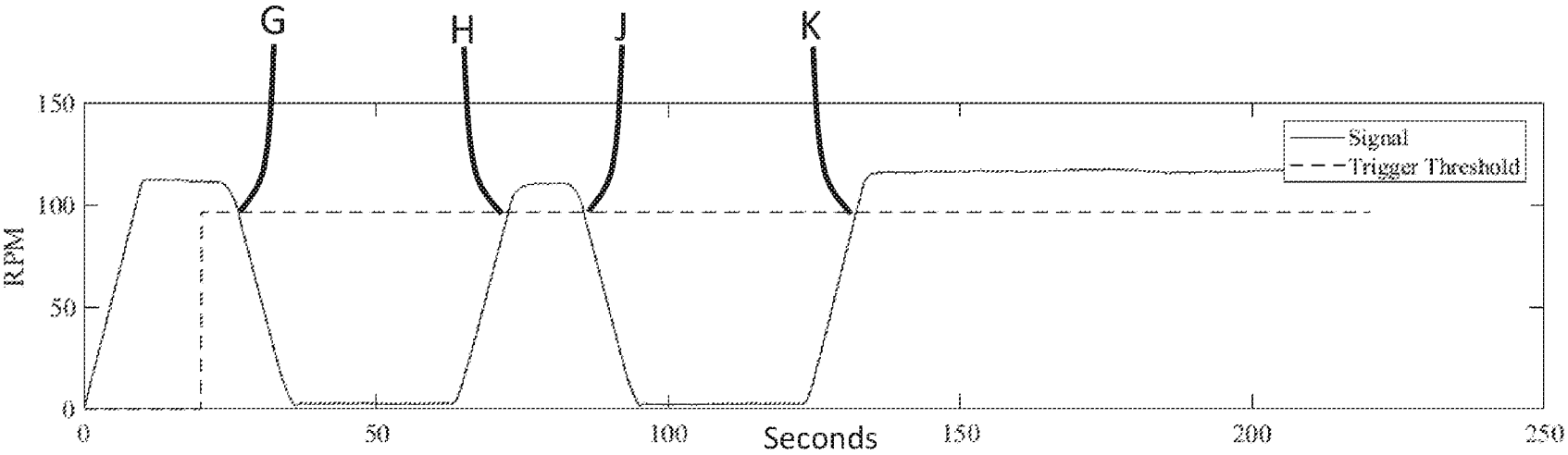

FIGS. 5A and 5B correspond to Example 1. Example 1 and FIGS. 5A, 5B depict conditions where the downlink was successful. This example also demonstrates the use of the correction factor, COR, to provide an Xeval value and Yeval value within the required ±5 seconds of the target values necessary for ensuring a verifiable downlink. In this instance, the actual T-pulse duration registered as 12.8 seconds, i.e. within the ±10 seconds of the 20 second target T-pulse duration. Additionally, the actual X-pulse duration was 46.1 seconds and the actual Y-pulse duration was 46.6 seconds. As indicated in FIG. 2, the target X-pulse duration was 40 seconds and the target Y-pulse duration was 40 seconds. The correction factor of for this example is 7.2 (COR=target T-pulse duration−actual T-pulse duration=20−12.8). Thus, application of the correction factor provides an Xeval value=actual X-pulse duration−(COR)=38.9 and a Yeval value=actual Y-pulse duration−(COR)=39.4. Thus, the correction factor provides an Xeval and a Yeval within the ±5 seconds of the target values necessary for ensuring a verifiable downlink. The transmission of the signal was successful.

Figure 6A:
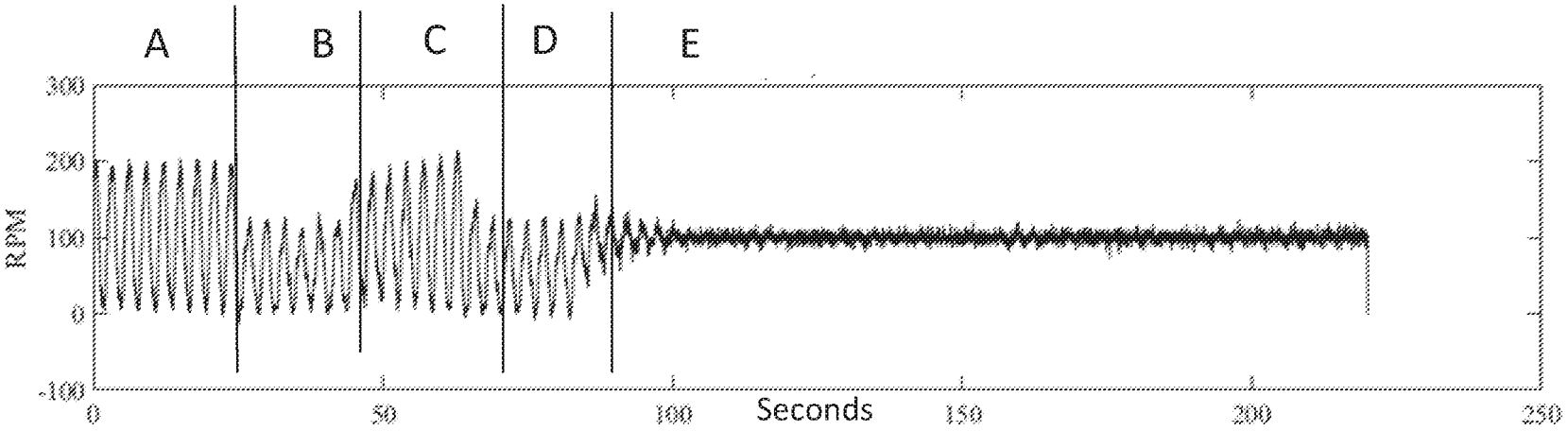
Figure 6B:
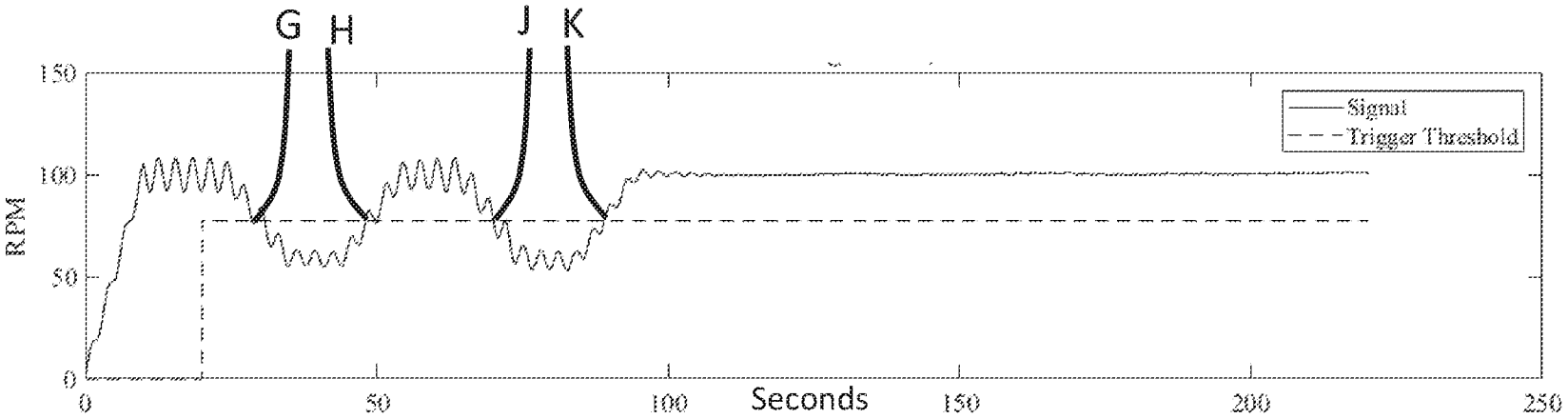

FIGS. 6A and 6B correspond to Example 2. Example 2 and FIGS. 6B, 6B depict conditions where the downlink was successful. In this instance, the actual T-pulse duration registered as 17.2 seconds, i.e. well within the ±10 of the 20 second target T-pulse duration. Additionally, the actual X-pulse duration was 22.9 seconds and the actual Y-pulse duration was 22.6 seconds. Thus, this particular example would have achieved a successful downlink without implementing the correction factor, COR, as the actual X-pulse and Y-pulse durations are well within the required ±5 seconds of the target X-pulse duration and the target Y-pulse duration necessary for a valid and verifiable downlink. In this instance, using the correction factor of 2.8 (COR=target T-pulse duration−measured T-pulse duration=20-17.2), provides an Xeval value of 20.1 and a Yeval value of 19.8. Additionally, Example 2 and FIG. 6B demonstrates the implementation of the rule concerning a secondary crossing of the threshold after initiating the X-pulse. As reflected in FIG. 6B, immediately after initiating the X-pulse, the RPM jumped above the Threshold RPM. However, because the increase occurred within the first 3 to 4 seconds after dropping below the Threshold RPM, the increase in RPM was ignored. Therefore, the transmitted signal was successfully received and the RSS confirmed the receipt by replying with a signal corresponding to the new downhole configuration.

Other embodiments of the present invention will be apparent to one skilled in the art. As such, the foregoing description merely enables and describes the general uses and methods of the present invention. Accordingly, the following claims define the true scope of the present invention.

What is claimed is:

1. A method for transmitting a signal to a controllable downhole tool located within a borehole, the method comprising the steps of:

positioning said controllable downhole tool and at least one sensor configured to monitor the revolutions per minute (RPM) of said controllable downhole tool;

said controllable downhole tool including a programmable memory, said programmable memory containing at least one lookup table preprogrammed with a plurality of commands for controlling said controllable downhole tool where each preprogrammed command corresponds to a combination of a determined Xeval value, and a determined Yeval value;

sending a signal to said controllable downhole tool to implement any of said plurality of preprogrammed commands from said lookup table by manipulating the RPM of said controllable downhole tool said signal including the steps of;

establishing a Starting RPM for said controllable downhole tool;

reducing the RPM of said controllable downhole tool from said Starting RPM;

establishing a Threshold RPM where said Threshold RPM is at least 5 RPM below the Starting RPM;

establishing a target X-pulse duration;

initiating an X-pulse;

begin recording the X-pulse when the RPM drops below the Threshold RPM and continuing to record the X-pulse until said RPM increases to the Threshold RPM where the actual X-pulse duration equals the number of seconds from RPM dropping below the Threshold RPM and the RPM returning to the Threshold RPM;

establishing a target T-pulse duration;

initiating a T-pulse when said RPM returns to the Threshold RPM;

recording the T-pulse;

concluding the T-pulse by reducing the RPM of said controllable downhole tool to the Threshold RPM where the actual T-pulse duration equals the number of seconds from RPM rising above the Threshold RPM and the RPM returning to the Threshold RPM;

establishing a target Y-pulse duration;

initiating a Y-pulse;

begin recording the Y-pulse when the RPM drops below the Threshold RPM and continuing to record the Y-pulse until said RPM increases to the Threshold RPM where the actual Y-pulse duration equals the number of seconds from RPM dropping below the Threshold RPM and the RPM returning to the Threshold RPM;

using said actual T-pulse duration to establish a correction factor (COR) using the following formula: COR=target T-pulse duration−(actual T-pulse duration);

determining the Xeval value by the formula: determined Xeval value=actual X-pulse duration−(COR);

determining the Yeval value by the formula: determined Yeval value=actual Y-pulse duration−(COR);

determining the acceptability of said signal to said controllable downhole tool to implement any one of said plurality of preprogrammed commands from said lookup table;

upon determination of an acceptable signal, said downhole tool uses said determined Xeval value and said determined Yeval value to select a preprogrammed command from said lookup table which corresponds to the combination of the determined Xeval value, and the determined Yeval value; and, controlling said downhole tool using the preprogrammed command selected from said lookup table.

2. The method of claim 1, wherein said method takes place during drilling operations and further comprising the step of sending a front signal to said controllable downhole tool, said front signal defining the Starting RPM as the RPM of the rotatable tool at the time of receipt of the front signal.

3. The method of claim 1, wherein the step of determining the acceptability of said signal to said controllable downhole tool to implement any one of said plurality of commands from said lookup table selects an acceptable preprogrammed command from said lookup table when said actual T-pulse duration is within ±20 seconds of said target T-pulse duration, said determined Xeval value is within ±10 seconds of the X-pulse duration and said determined Yeval value is within ±10 seconds of the Y-pulse duration.

4. The method of claim 1, wherein the step of determining the acceptability of said signal to said controllable downhole tool to implement any one of said plurality of said preprogrammed commands from said lookup table selects an acceptable preprogrammed command from said lookup table when said actual T-pulse duration is within ±10 seconds of said target T-pulse duration, said determined Xeval value is within ±5 seconds of the target X-pulse duration and said determined Yeval value is within ±5 seconds of the target Y-pulse duration.

5. The method of claim 1, wherein said controllable downhole tool includes at least a first lookup table and a second lookup table and further comprising the step of selecting the first lookup table when said actual T-pulse duration is between about 10 seconds to about 30 seconds and selecting said second lookup table when said actual T-pulse duration is between about 40 seconds to about 80 seconds.

6. The method of claim 1, further comprising the step of said controllable tool transmitting a verification signal indicating the implementation of the selected preprogrammed command from said lookup table.

7. The method of claim 1, further comprising the step of ignoring an increase of RPM above the Threshold RPM which occurs within the first four seconds of recording the X-pulse.

8. The method of claim 1, further comprising the step of ignoring an increase of RPM above the Threshold RPM which occurs within the first four seconds of recording the Y-pulse.

9. The method of claim 1, further comprising the step of ignoring a decrease of RPM below the Threshold RPM which occurs within the first four seconds of recording the T-pulse.

10. The method of claim 1, wherein said target T-pulse duration is between about 8 seconds and 120 seconds.

11. The method of claim 1, wherein said target X-pulse duration is between about 8 seconds and 120 seconds and the target Y-pulse duration is between about 8 seconds and 120 seconds.

12. A method for transmitting a signal to a controllable downhole tool located within a borehole, the method comprising the steps of:

positioning said controllable downhole tool and at least one sensor configured to monitor the revolutions per minute (RPM) of said controllable downhole tool;

said controllable downhole tool including a programmable memory, said programmable memory containing at least one lookup table preprogrammed with a plurality of commands for controlling said controllable downhole tool where each preprogrammed command corresponds to a combination of a determined Xeval value, and a determined Yeval value;

sending a signal to said controllable downhole tool to implement any of said plurality of preprogrammed commands from said lookup table by manipulating the RPM of said controllable downhole tool said signal including the steps of;

establishing a Starting RPM for said controllable downhole tool;

increasing the RPM of said controllable downhole tool from said Starting RPM;

establishing a Threshold RPM where said Threshold RPM is at least 5 RPM above the Starting RPM;

establishing a target X-pulse duration;

initiating an X-pulse;

begin recording the X-pulse when the RPM increases above the Threshold RPM and continuing to record the X-pulse until said RPM drops to the Threshold RPM where the actual X-pulse duration equals the number of seconds from RPM increasing above the Threshold RPM and the RPM returning to the Threshold RPM;

establishing a target T-pulse duration;

initiating a T-pulse when said RPM returns to the Threshold RPM;

recording the T-pulse;

concluding the T-pulse by increasing the RPM of said controllable downhole tool to the Threshold RPM where the actual T-pulse duration equals the number of seconds from the RPM dropping below the Threshold RPM and the RPM returning to the Threshold RPM;

establishing a target Y-pulse duration;

initiating a Y-pulse;

begin recording the Y-pulse when the RPM increases above the Threshold RPM and continuing to record the Y-pulse until said RPM drops to the Threshold RPM where the actual Y-pulse duration equals the number of seconds from the RPM increasing above the Threshold RPM and the RPM returning to the Threshold RPM;

using said actual T-pulse duration to establish a correction factor (COR) using the following formula: COR=target T-pulse duration−(actual T-pulse duration);

determining the Xeval value by the formula: determined Xeval value=actual X-pulse duration−(COR);

determining the Yeval value by the formula: determined Yeval value=actual Y-pulse duration−(COR);

determining the acceptability of said signal to said controllable downhole tool to implement any one of said plurality of preprogrammed commands from said lookup table;

upon determination of an acceptable signal, said downhole tool uses said determined Xeval value and said determined Yeval value to select a preprogrammed command from said lookup table which corresponds to the combination of the determined Xeval value and, the determined Yeval value; and, controlling said downhole tool using the preprogrammed command selected from said lookup table.

13. The method of claim 1, wherein in the step of determining the acceptability of said signal to said controllable downhole tool to implement a preprogrammed command from said lookup table is determined when said actual T-pulse duration value is within ±30 seconds of said target T-pulse duration, said determined Xeval value is within ±15 seconds of the target X-pulse duration and said determined Yeval value is within ±15 seconds of the target Y-pulse duration.

14. The method of claim 12, further comprising the step of ignoring an increase of RPM above the Threshold RPM which occurs within the first four seconds of recording the T-pulse.

15. The method of claim 12, wherein said method takes place during drilling operations and further comprising the step of sending a front signal to said controllable downhole tool, said front signal defining the Starting RPM as the RPM of the rotatable tool at the time of receipt of the front signal.

16. The method of claim 12, wherein the step of determining the acceptability of said signal to said controllable downhole tool to implement any one of said plurality of commands from said lookup table selects an acceptable preprogrammed command from said lookup table when said actual T-pulse duration is within ±20 seconds of said target T-pulse duration, said determined Xeval value is within ±10 seconds of the X-pulse duration and said determined Yeval value is within ±10 seconds of the Y-pulse duration.

17. The method of claim 12, wherein the step of determining the acceptability of said signal to said controllable downhole tool to implement any one of said plurality of said preprogrammed commands from said lookup table selects an acceptable preprogrammed command from said lookup table when said actual T-pulse duration is within ±10 seconds of said target T-pulse duration, said determined Xeval value is within ±5 seconds of the target X-pulse duration and said determined Yeval value is within ±5 seconds of the target Y-pulse duration.

18. The method of claim 12, wherein said controllable downhole tool includes at least a first lookup table and a second lookup table and further comprising the step of selecting the first lookup table when said actual T-pulse duration is between about 10 seconds to about 30 seconds and selecting said second lookup table when said actual T-pulse duration is between about 40 seconds to about 80 seconds.

19. The method of claim 12, further comprising the step of said controllable tool transmitting a verification signal indicating the implementation of the selected preprogrammed command from said lookup table.

20. The method of claim 12, further comprising the step of ignoring a decrease of RPM below the Threshold RPM which occurs within the first four seconds of recording the X-pulse.

21. The method of claim 12, further comprising the step of ignoring a decrease of RPM below the Threshold RPM which occurs within the first four seconds of recording the Y-pulse.

22. The method of claim 12, wherein said target T-pulse duration is between about 8 seconds and 120 seconds.

23. The method of claim 12, wherein said target X-pulse duration is between about 8 seconds and 120 seconds and the target Y-pulse duration is between about 8 seconds and 120 seconds.

24. The method of claim 12, wherein in the step of determining the acceptability of said signal to said controllable downhole tool to implement a preprogrammed command from said lookup table is determined when said actual T-pulse duration value is within ±30 seconds of said target T-pulse duration, said determined Xeval value is within +15 seconds of the target X-pulse duration and said determined Yeval value is within ±15 seconds of the target Y-pulse duration.

25. A method for transmitting a signal to a controllable downhole tool located within a borehole, the method comprising the steps of:

positioning said controllable downhole tool and at least one sensor configured to monitor the revolutions per minute (RPM) of said controllable downhole tool;

said controllable downhole tool including a programmable memory, said programmable memory containing at least one lookup table preprogrammed with a plurality of commands for controlling said controllable downhole tool where each preprogrammed command corresponds to a combination of a determined Xeval value, and a determined Yeval value;

sending a signal to said controllable downhole tool to implement any one of said plurality of preprogrammed commands from said lookup table by manipulating the RPM of said controllable downhole tool said signal including the steps of;

establishing a Starting RPM for said controllable downhole tool;

establishing a first Threshold RPM where said first Threshold RPM is at least 5 RPM below the Starting RPM;

establishing a second Threshold RPM where said second Threshold RPM is at least 5 RPM above the Starting RPM;

establishing a target X-pulse duration;

initiating an X-pulse;

changing the RPM of said controllable downhole tool from said Starting RPM;

begin recording the X-pulse when the RPM increases above the second Threshold RPM or begin recording the X-pulse when the RPM decreases below the first Threshold RPM;

continuing to record the X-pulse until said RPM returns to the Threshold RPM, where the actual X-pulse duration equals the number of seconds from RPM increasing above the second Threshold RPM and the RPM returning to the Threshold RPM or where the actual X-pulse duration equals the number of seconds from RPM dropping below the first Threshold RPM and the RPM returning to the Threshold RPM;

establishing a target T-pulse duration;

initiating a T-pulse when said RPM returns to the second Threshold RPM or when said RPM returns to the first Threshold RPM;

recording the T-pulse;

concluding the T-pulse by increasing the RPM of said controllable downhole tool to the Threshold RPM or by reducing the RPM of said controllable downhole tool to the Threshold RPM where the actual T-pulse duration equals the number of seconds from RPM dropping below the second Threshold RPM and the RPM returning to the Threshold RPM or where the actual T-pulse duration equals the number of seconds from RPM rising above the first Threshold RPM and the RPM returning to the Threshold RPM;

establishing a target Y-pulse duration;

initiating a Y-pulse;

begin recording the Y-pulse when the RPM increases above the second Threshold RPM or begin recording the Y-pulse when the RPM decreases below the first Threshold RPM where the actual Y-pulse duration equals the number of seconds from RPM increasing above the second Threshold RPM and the RPM returning to the Threshold RPM or where the actual Y-pulse duration equals the number of seconds from RPM dropping below the first Threshold RPM and the RPM returning to the Threshold RPM;

using said actual T-pulse duration to establish a correction factor (COR) using the following formula: COR=target T-pulse duration−(actual T-pulse duration);

determining the Xeval value by the formula: determined Xeval value=actual X-pulse duration−(COR);

determining the Yeval value by the formula: determined Yeval value=actual Y-pulse duration−(COR);

determining the acceptability of said signal to said controllable downhole tool to implement any one of said preprogrammed commands from said lookup table;

upon determination of an acceptable signal, said downhole tool uses said determined Xeval value and said determined Yeval value to select a preprogrammed command from said lookup table which corresponds to the combination of the determined Xeval value, and the determined Yeval value; and, controlling said downhole tool using the preprogrammed command selected from said lookup table.

26. The method of claim 25, wherein said method takes place during drilling operations and further comprising the step of sending a front signal to said controllable downhole tool, said front signal defining the Starting RPM as the RPM of the rotatable tool at the time of receipt of the front signal.

27. The method of claim 25, wherein the step of determining the acceptability of said signal to said controllable downhole tool to implement any one of said plurality of commands from said lookup table selects an acceptable preprogrammed command from said lookup table when said actual T-pulse duration is within ±20 seconds of said target T-pulse duration, said determined Xeval value is within ±10 seconds of the X-pulse duration and said determined Yeval value is within ±10 seconds of the Y-pulse duration.

28. The method of claim 25, wherein the step of determining the acceptability of said signal to said controllable downhole tool to implement any one of said plurality of preprogrammed commands from said lookup table selects an acceptable preprogrammed command from said lookup table when said actual T-pulse duration is within ±10 seconds, said determined Xeval value is within ±5 seconds of the X-pulse duration and said determined Yeval value is within ±5 seconds of the Y-pulse duration.

29. The method of claim 25, wherein said controllable downhole tool includes at least a first lookup table and a second lookup table and further comprising the step of selecting the first lookup table when said actual T-pulse duration is between about 10 seconds to about 30 seconds and selecting said second lookup table when said actual T-pulse duration is between about 40 seconds to about 80 seconds.

30. The method of claim 25, further comprising the step of said controllable tool transmitting a verification signal indicating the implementation of the selected preprogrammed command from said lookup table.

31. The method of claim 25, further comprising the step of ignoring an increase of RPM above the Threshold RPM which occurs within the first four seconds of recording the X-pulse when a decrease in RPM below the Threshold RPM is used to produce the X-pulse.

32. The method of claim 25, further comprising the step of ignoring an increase of RPM above the Threshold RPM which occurs within the first four seconds of recording the Y-pulse when a decrease in RPM below the Threshold RPM is used to produce the Y-pulse.

33. The method of claim 25, further comprising the step of ignoring an increase of RPM above the Threshold RPM which occurs within the first four seconds of recording the T-pulse when a decrease in RPM below the Threshold RPM is used to produce the T-pulse.

34. The method of claim 25, further comprising the step of ignoring a decrease of RPM below the Threshold RPM which occurs within the first four seconds of recording the X-pulse when an increase above the Threshold RPM is used to produce the X-pulse.

35. The method of claim 25, further comprising the step of ignoring a decrease of RPM below the Threshold RPM which occurs within the first four seconds of recording the Y-pulse when an increase above the Threshold RPM is used to produce the Y-pulse.

36. The method of claim 25, further comprising the step of ignoring a decrease of RPM below the Threshold RPM which occurs within the first four seconds of recording the T-pulse when an increase above the Threshold RPM is used to produce the T-pulse.

37. The method of claim 25, wherein said target T-pulse duration is between about 8 seconds and 120 seconds.

38. The method of claim 25, wherein said target X-pulse duration is between about 8 seconds and 120 seconds and the target Y-pulse duration is between about 8 seconds and 120 seconds.

39. The method of claim 25, wherein in the step of determining the acceptability of said signal to said controllable downhole tool to implement a preprogrammed command from said lookup table is determined when said actual T-pulse duration value is within ±30 seconds of said target T-pulse duration, said determined Xeval value is within ±15 seconds of the target X-pulse duration and said determined Yeval value is within ±15 seconds of the target Y-pulse duration.

* * * * *